US010040652B2

(12) United States Patent
Fujita

(10) Patent No.: US 10,040,652 B2
(45) Date of Patent: Aug. 7, 2018

(54) SHEET FEEDING APPARATUS, SHEET CONVEYANCE APPARATUS, AND IMAGE FORMING APPARATUS

(71) Applicant: CANON KABUSHIKI KAISHA, Tokyo (JP)

(72) Inventor: Keiko Fujita, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/245,504

(22) Filed: Aug. 24, 2016

(65) Prior Publication Data

US 2017/0060066 A1 Mar. 2, 2017

(30) Foreign Application Priority Data

Sep. 2, 2015 (JP) ..... 2015-172809

(51) Int. Cl.
*B65H 3/66* (2006.01)
*B65H 3/06* (2006.01)
(Continued)

(52) U.S. Cl.
CPC ..... *B65H 3/66* (2013.01); *B65H 1/266* (2013.01); *B65H 3/0638* (2013.01); *B65H 1/04* (2013.01); *B65H 1/28* (2013.01); *B65H 5/06* (2013.01); *B65H 2405/10* (2013.01); *B65H 2801/06* (2013.01); *G03G 15/6505* (2013.01); *G03G 15/6511* (2013.01); *G03G 15/6529* (2013.01);
(Continued)

(58) Field of Classification Search
CPC ..... B65H 3/66; B65H 3/68; B65H 3/0638; B65H 5/36; B65H 5/38; B65H 2404/50; B65H 2404/5211; B65H 2601/321
See application file for complete search history.

(56) References Cited

U.S. PATENT DOCUMENTS 6,741,815 B1 5/2004 Fujita et al.
7,597,311 B2 10/2009 Kawata et al.
(Continued)

FOREIGN PATENT DOCUMENTS

JP H09-240852 A 9/1997
JP 2004-299825 A 10/2004

OTHER PUBLICATIONS

Japanese Office Action issued in corresponding Japanese Application No. 2015-172809 dated Jul. 18, 2017.

*Primary Examiner* — Patrick Cicchino
(74) *Attorney, Agent, or Firm* — Fitzpatrick, Cella, Harper & Scinto

(57) ABSTRACT

A sheet feeding apparatus includes a supporting portion and a feeding unit. The supporting portion supports a sheet and is capable of being drawn out from and being attached to an apparatus body. The feeding unit is provided in the apparatus body and includes a feeding portion, a conveyance portion, a separation unit, and a guide member. The feeding portion feeds the sheet supported by the supporting portion. The conveyance portion conveys the sheet. The separation unit forms a separation nip with the conveyance portion and is detachable from the feeding unit. The guide member includes a guide surface and a lower surface. The guide surface guides the sheet to the separation nip. The lower surface is provided below the guide surface and includes an exposing portion exposing at least a part of the separation unit.

21 Claims, 9 Drawing Sheets

(51) Int. Cl.

| | |
|---|---|
| ***B65H 5/06*** | (2006.01) |
| ***B65H 1/28*** | (2006.01) |
| ***B65H 1/04*** | (2006.01) |
| ***G03G 15/00*** | (2006.01) |
| ***B65H 1/26*** | (2006.01) |

(52) U.S. Cl.

CPC ..... *G03G 2215/004* (2013.01); *G03G 2215/00383* (2013.01); *G03G 2215/00396* (2013.01); *G03G 2215/00679* (2013.01); *G03G 2215/0132* (2013.01)

(56) References Cited

U.S. PATENT DOCUMENTS

| | | | | |
|---|---|---|---|---|
| 7,681,874 | B2 * | 3/2010 | Kusumi | B65H 3/44 271/10.1 |
| 7,922,167 | B2 * | 4/2011 | Kajiyama | B65H 5/025 271/10.01 |
| 8,047,539 | B2 | 11/2011 | Fujita | |
| 8,177,216 | B2 * | 5/2012 | Watase | B65H 3/44 271/10.1 |
| 8,186,674 | B2 | 5/2012 | Fujita | |
| 8,695,965 | B2 * | 4/2014 | Shin | B65H 1/266 271/121 |
| 8,864,123 | B2 | 10/2014 | Kamiyama et al. | |
| 9,624,057 | B2 * | 4/2017 | Itabashi | B65H 5/36 |
| 2010/0111583 | A1 | 5/2010 | Fujita | |
| 2015/0097334 | A1 * | 4/2015 | Sekiguchi | B65H 5/06 271/275 |

* cited by examiner

SHEET FEEDING APPARATUS, SHEET CONVEYANCE APPARATUS, AND IMAGE FORMING APPARATUS

BACKGROUND OF THE INVENTION

Field of the Invention

The present invention relates to a sheet feeding apparatus for feeding a sheet, a sheet conveyance apparatus for conveying a sheet, and an image forming apparatus.

Description of the Related Art

An image forming apparatus such as a printer including a cassette that stores a stack of sheets and can be drawn out from an apparatus body is generally known. This kind of image forming apparatus separates sheets fed from the cassette by a pickup roller from one another with a conveyance roller and a retard roller.

Conventionally, Japanese Unexamined Patent Application Publication No. 2004-299825 has proposed an image forming apparatus including a cassette provided with a guide. The guide is provided downstream of a retard roller in a drawing-out direction and guides a sheet to the retard roller and a conveyance roller. The retard roller wears out from contact with the sheet and the conveyance roller, and thus needs to be replaced after some time. In the case of replacing the retard roller, a user draws out the cassette, cancels the engagement between a claw member and a shaft, and then draws out the retard roller downstream in the drawing-out direction. The claw member is formed on an end portion of the retard roller.

In these years, as a result of miniaturization of image forming apparatuses, retard rollers have been miniaturized, and the space around a retard roller has also become smaller. In the image forming apparatus described in Japanese Unexamined Patent Application Publication No. 2004-299825, it has been difficult to replace the retard roller in the case where, for example, the space for holding an engagement claw is narrow.

SUMMARY OF THE INVENTION

According to a first aspect of the present invention, a sheet feeding apparatus includes an apparatus body, a supporting portion configured to support a sheet and to be drawn out from and attached to the apparatus body, and a feeding unit provided in the apparatus body. The feeding unit includes a feeding portion configured to feed the sheet supported by the supporting portion, a conveyance portion configured to convey the sheet fed by the feeding portion, a separation portion configured to form a separation nip, in which sheets are separated one by one, with the conveyance portion, the separation portion being detachable from the feeding portion, and a guide member comprising a guide surface and a lower surface, the guide surface being configured to guide the sheet fed by the feeding portion to the separation nip, the lower surface being provided below the guide surface and defining an exposing portion exposing at least a part of the separation portion.

According to a second aspect of the present invention, a sheet conveyance apparatus includes an apparatus body, a cassette configured to support a sheet and to be drawn out from the apparatus body, and a conveyance unit provided in the apparatus body. The conveyance unit includes a conveyance rotary member configured to convey a sheet, a rotation shaft rotatably supported by the apparatus body, a retard roller that is capable of being in contact with the conveyance rotary member and is detachable from the rotation shaft, a torque limiter provided between the rotation shaft and the retard roller, a guide member comprising a guide surface and a lower surface, the guide surface being configured to guide a sheet to a contact portion at which the conveyance rotary member and the retard roller comes into contact, the lower surface being provided below the guide surface and defining an exposing portion exposing at least a part of the retard roller.

Further features of the present invention will become apparent from the following description of exemplary embodiments with reference to the attached drawings.

DESCRIPTION OF THE EMBODIMENTS

Exemplary embodiments of the present invention will be described below with reference to the drawings. In the description below, the positional relationship between up, down, left, right, front, and back will be described by setting as a standard a state in which an image forming apparatus is viewed straight from the front, that is, from a viewpoint of FIG. 1.

First Exemplary Embodiment

Image Forming Apparatus

Figure 1:
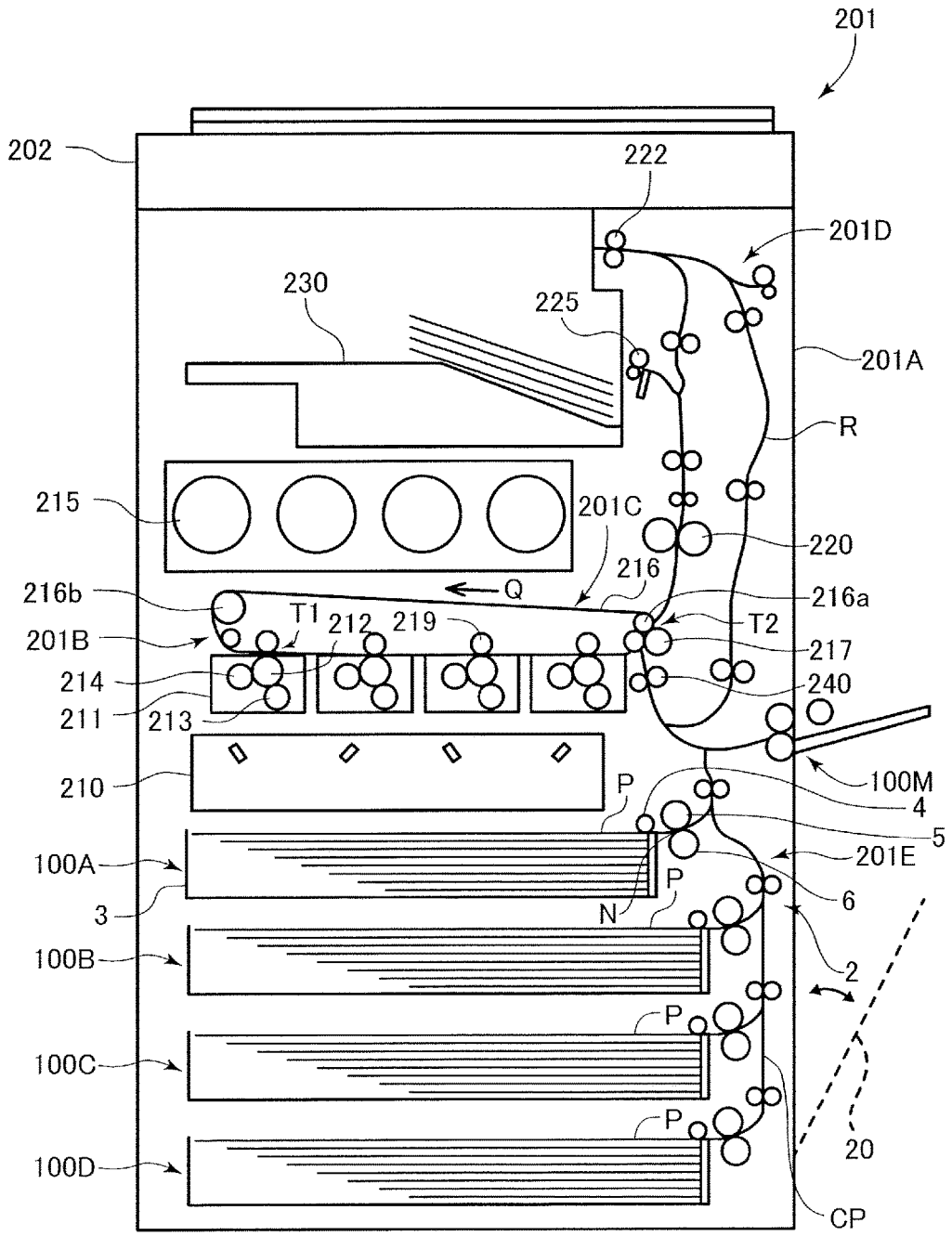
FIG. 1 is an overall schematic view of a printer according to a first exemplary embodiment.

A printer 201 is an image forming apparatus according to the first exemplary embodiment. The printer 201 is a full-color laser beam printer that uses electrophotography. As illustrated in FIG. 1, the printer 201 includes a printer body 201A and a reading apparatus 202. The printer body 201A is an apparatus body. The reading apparatus is provided in an upper part of the printer body 201A and is configured to read image data of a document.

The printer body 201A includes an image forming unit 201B, a fixing unit 220, and so forth. The image forming unit 201B forms an image on a sheet P, and the fixing unit 220 fixes the image to the sheet P. A discharge space is defined between the reading apparatus 202 and the printer body 201A, and a discharge tray 230 is provided in the discharge space. A sheet P that has been discharged is supported on the discharge tray. The printer body 201A is also provided with a sheet feeding section 201E that feeds the sheet P to the image forming unit 201B. The sheet feeding section 201E includes cassette feeders 100A, 100B, 100C, and 100D, and a manual feeder 100M. The cassette feeders 100A to 100D are sheet feeding apparatuses disposed in a lower part of the printer body 201A. The manual feeder 100M is disposed on a right side portion of the printer body 201A. The right side portion of the printer body 201A also supports a door 20 in such a manner that the door 20 is openable and closable. The door 20 is movable between a closed position and an opened position with respect to the printer body 201A. By positioning the door 20 at the opened position indicated by a broken line in FIG. 1, a conveyance path CP that extends from the cassette feeders 100A to 100D to the image forming unit 201B can be exposed to the outside. In the case where the sheet P is jammed in the conveyance path CP, the sheet P can be removed by positioning the door 20 at the opened position.

The image forming unit 201B is of a so-called four-drum full-color type and includes a laser scanner 210, four process cartridges 211, and an intermediate transfer unit 201C. The process cartridges 211 respectively form toner images of yellow, magenta, cyan, and black. The colors will be hereinafter indicated by Y, M, C, and K, respectively. The process cartridges 211 each include a photosensitive drum 212, an electrifier 213, a developing unit 214, a cleaner that is not illustrated, and so forth. Toner cartridges 215 accommodating toners of respective colors are attached above the image forming unit 201B so as to be attachable to and detachable from the printer body 201A.

The intermediate transfer unit 201C includes an intermediate transfer belt 216 that is looped over a driving roller 216*a*, a tension roller 216*b*, and so forth. The intermediate transfer belt 216 is disposed above the four process cartridges 211. The intermediate transfer belt 216 is disposed so as to be in contact with each photosensitive drum 212 of the process cartridges 211, and is driven by the driving roller 216*a* to rotate in a counterclockwise direction, i.e., an arrow Q direction. The driving roller 216*a* is driven by a driving unit that is not illustrated. The intermediate transfer unit 201C includes primary transfer rollers 219 that abut the inner peripheral surface of the intermediate transfer belt 216 at positions opposing respective photosensitive drums 212. Primary transfer portions T1 are formed as nip portions between the intermediate transfer belt 216 and the photosensitive drums 212. In addition, the image forming unit 201B includes a secondary transfer roller 217 that abuts the outer peripheral surface of the intermediate transfer belt 216 at a position opposing the driving roller 216*a*. A secondary transfer portion T2 is formed as a nip portion between the secondary transfer roller 217 and the intermediate transfer belt 216. At the secondary transfer portion T2, a toner image carried by the intermediate transfer belt 216 is transferred onto the sheet P.

In the process cartridges 211 configured as described above, electrostatic latent images are drawn on the surfaces of the photosensitive drums 212 by the laser scanners 210, and then toner images of respective colors that are electrified to a negative polarity are formed on the surfaces of the photosensitive drums 212 with toner being supplied from the developing units 214. A transfer bias voltage having a positive polarity is applied to the primary transfer rollers 219, and these toner images are thereby sequentially transferred onto the intermediate transfer belt 216 at respective primary transfer portions T1 so as to be superimposed on one another. As a result of this, a full-color toner image is formed on the intermediate transfer belt 216.

In parallel with the process of forming the toner image described above, the sheet P fed from the sheet feeding section 201E is conveyed to a registration roller pair 240. The registration roller pair 240 corrects the skew of the sheet P. The registration roller pair 240 conveys the sheet P to the secondary transfer portion T2 at a timing matching a transfer timing of the full-color toner image formed on the intermediate transfer belt 216. The toner image carried by the intermediate transfer belt 216 is transferred onto the sheet P at the secondary transfer portion T2 as a result of a transfer bias voltage of a positive polarity being applied to the secondary transfer roller 217.

The sheet P onto which the toner image has been transferred is subjected to heat and pressure applied by the fixing unit 220, and a color image is thereby fixed onto the sheet P. The sheet P onto which the color image has been fixed is discharged to the discharge tray 230 by a discharge roller pair 225 and then stacked. In the case where images are to be formed on both surfaces of the sheet P, the sheet P is switched back by a reverse roller pair 222 after passing through the fixing unit 220. The reverse roller pair 222 is provided in a reverse conveyance section 201D and is capable of rotating forward and backward. The sheet P is then conveyed again to the image forming unit 201B through a re-conveyance path R, and an image is formed on a back surface of the sheet P.

Cassette Feeder

The cassette feeders 100A to 100D will be described below. These four-tiered cassette feeders 100A to 100D are the same in configuration, and thus descriptions of cassette feeders 100B to 100D are omitted and just the uppermost cassette feeder 100A will be described hereinbelow.

Figure 2:
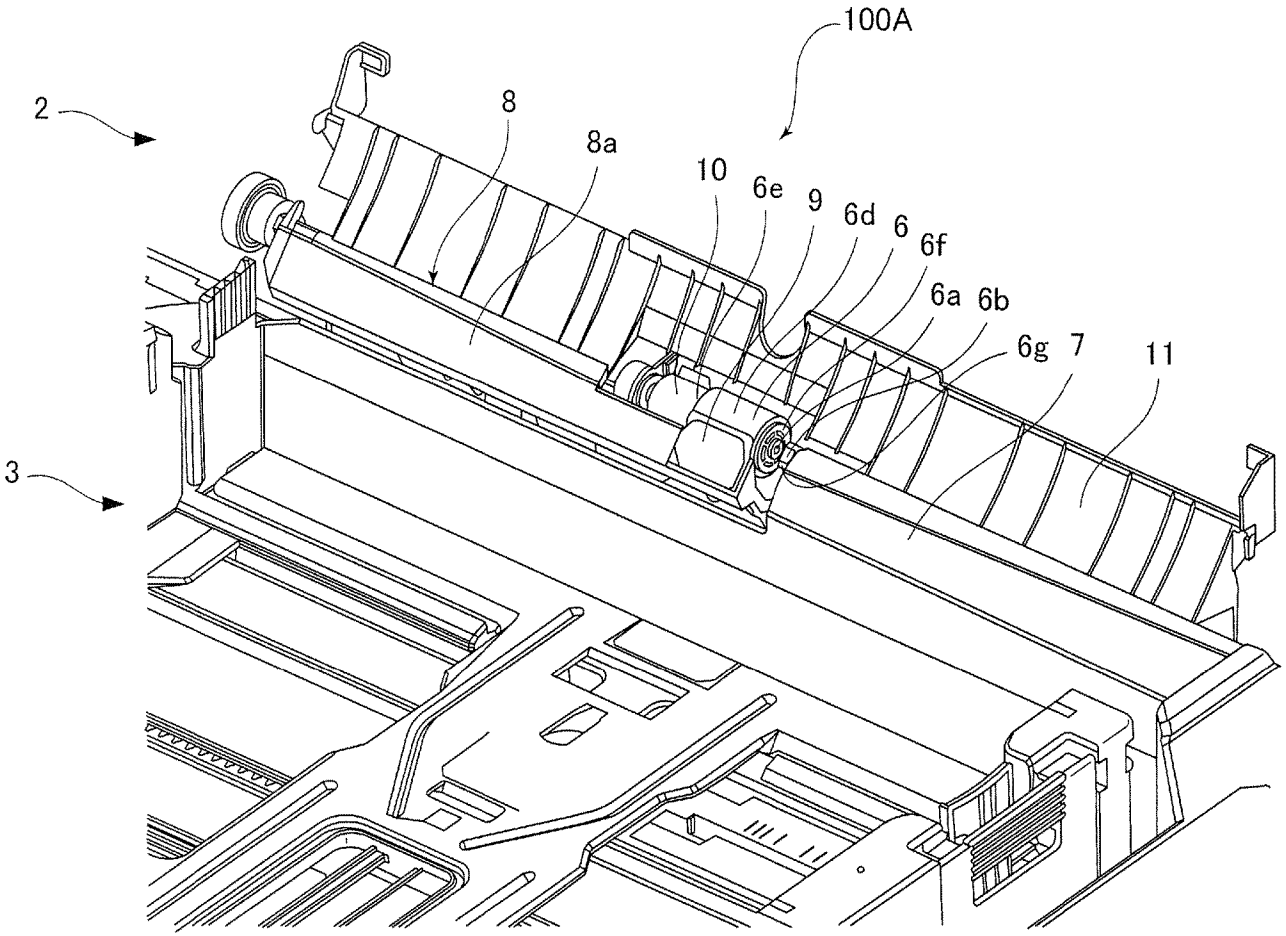
FIG. 2 is a perspective view of a cassette feeder.
Figure 4:
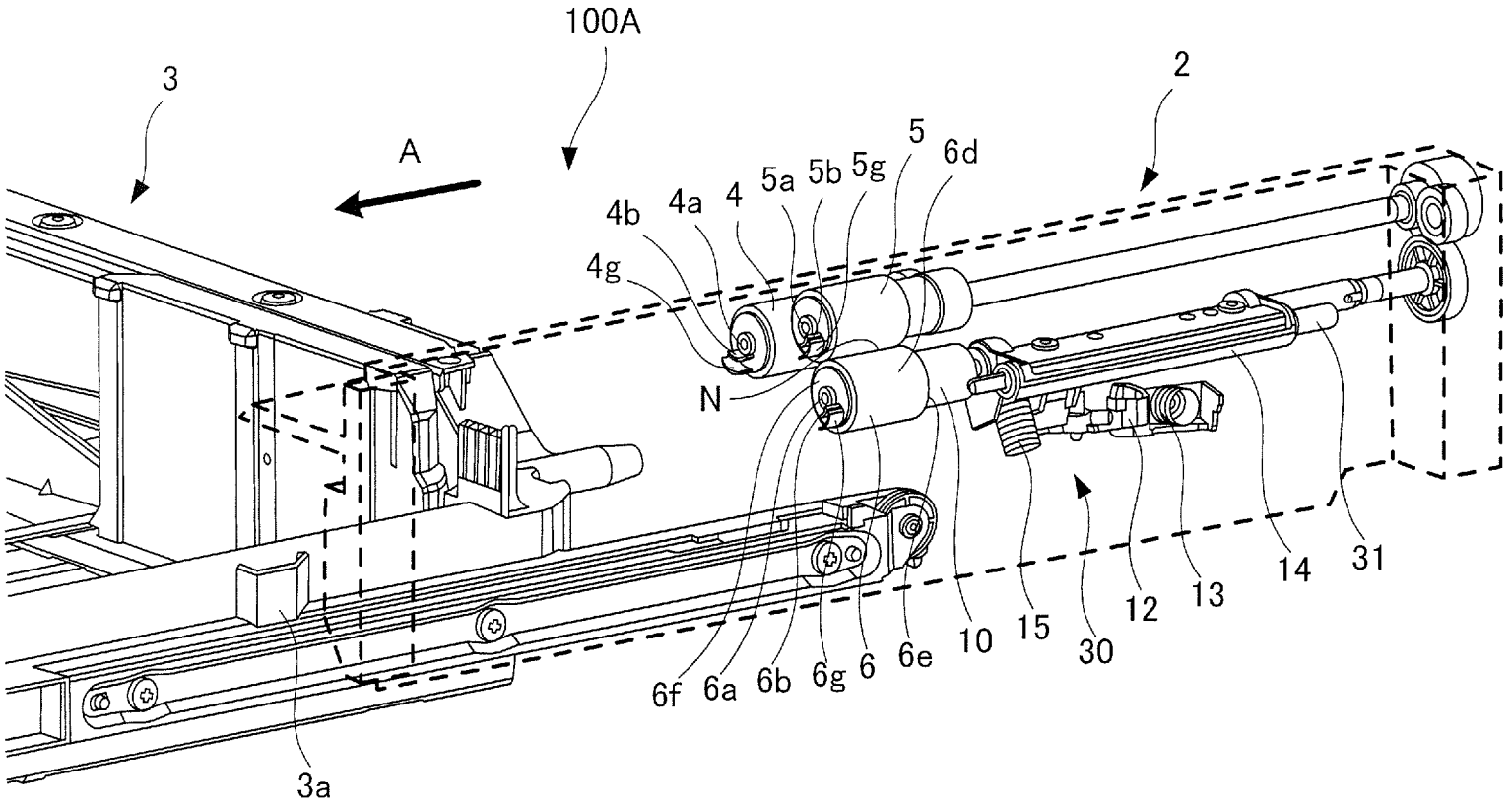
FIG. 4 is a perspective view of a feeding unit and a separating mechanism.

As illustrated in FIGS. 1 and 2, the cassette feeder 100A includes a feeding unit 2 and a cassette 3. The feeding unit 2 is provided in the printer body 201A. The cassette 3 is a supporting portion that supports the sheet P and is capable of being drawn out from and being attached to the printer body 201A. The feeding unit 2 includes a pickup roller 4 and a feed roller 5. The pickup roller 4 is a feeding portion that feeds the sheet P supported in the cassette 3. The feed roller 5 is a conveyance portion that conveys the sheet P fed by the pickup roller 4. The feeding unit 2 also includes a retard roller 6, a conveyance guide 8, a downstream conveyance guide 11, and a separating mechanism 30. The retard roller 6 is a separation portion that forms a separation nip N, in which sheets are separated one by one, with the feed roller 5. The separation nip N is a contact portion. The conveyance guide 8 guides the sheet P to the separation nip N. The separating mechanism 30 is illustrated by FIG. 4.

Figure 5:
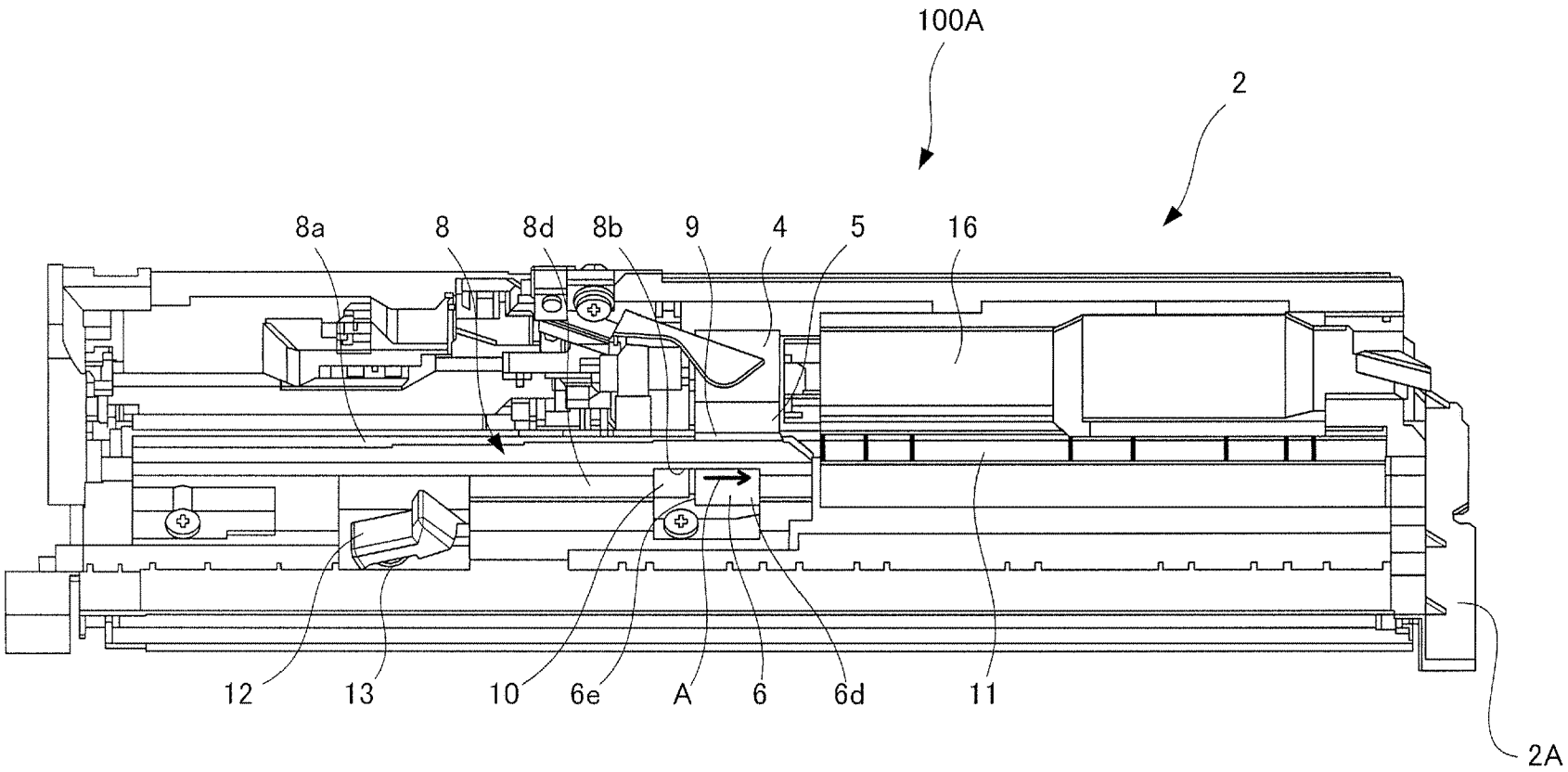
FIG. 5 is a bottom view of a cutout hole in a conveyance guide.

The conveyance guide 8, which is a guide member, supports a roller guide 9. The roller guide 9 extends within the width of the retard roller 6, is disposed near the separation nip N, and is formed of, for example, a thin plate material such as a stainless steel plate and a resin sheet. The sheet P fed by the pickup roller 4 is guided, at least at a region within the width of the retard roller 6, by the roller guide 9 and the downstream conveyance guide 11 at regions upstream and downstream of the separation nip N. Moreover, as illustrated in FIG. 5, the feeding unit 2 includes the conveyance upper guide 16, i.e., movable member, which is slidably supported by a frame 2A of the feeding unit 2, and opposes to a cassette guide 7 and the downstream conveyance guide 11. The roller guide 9, the downstream conveyance guide 11, and the conveyance upper guide 16 are all supported by the feeding unit 2. Thus, relative positions of components can be determined with high precision. According to this, even in the case where a retard roller 6 with a small diameter is used, the leading end of the sheet P is conveyed to the separation nip N with certainty and thus conveyance of the sheet becomes more stable.

In addition, the cassette 3 is provided with a cassette guide 7 formed therein. The cassette guide 7 is a downstream guide portion that is provided downstream of the retard roller 6 in the drawing-out direction of the cassette 3 and guide the sheet P to the separation nip N. The cassette guide 7, the roller guide 9, and the conveyance guide 8 are disposed so as to be arranged in the width direction of the sheet, i.e., the drawing-out direction of the cassette 3, in a state where the cassette 3 is attached to the printer body 201A. This allows conveying sheets of various sizes to the separation nip N with certainty.

Retard Roller

Figure 3:
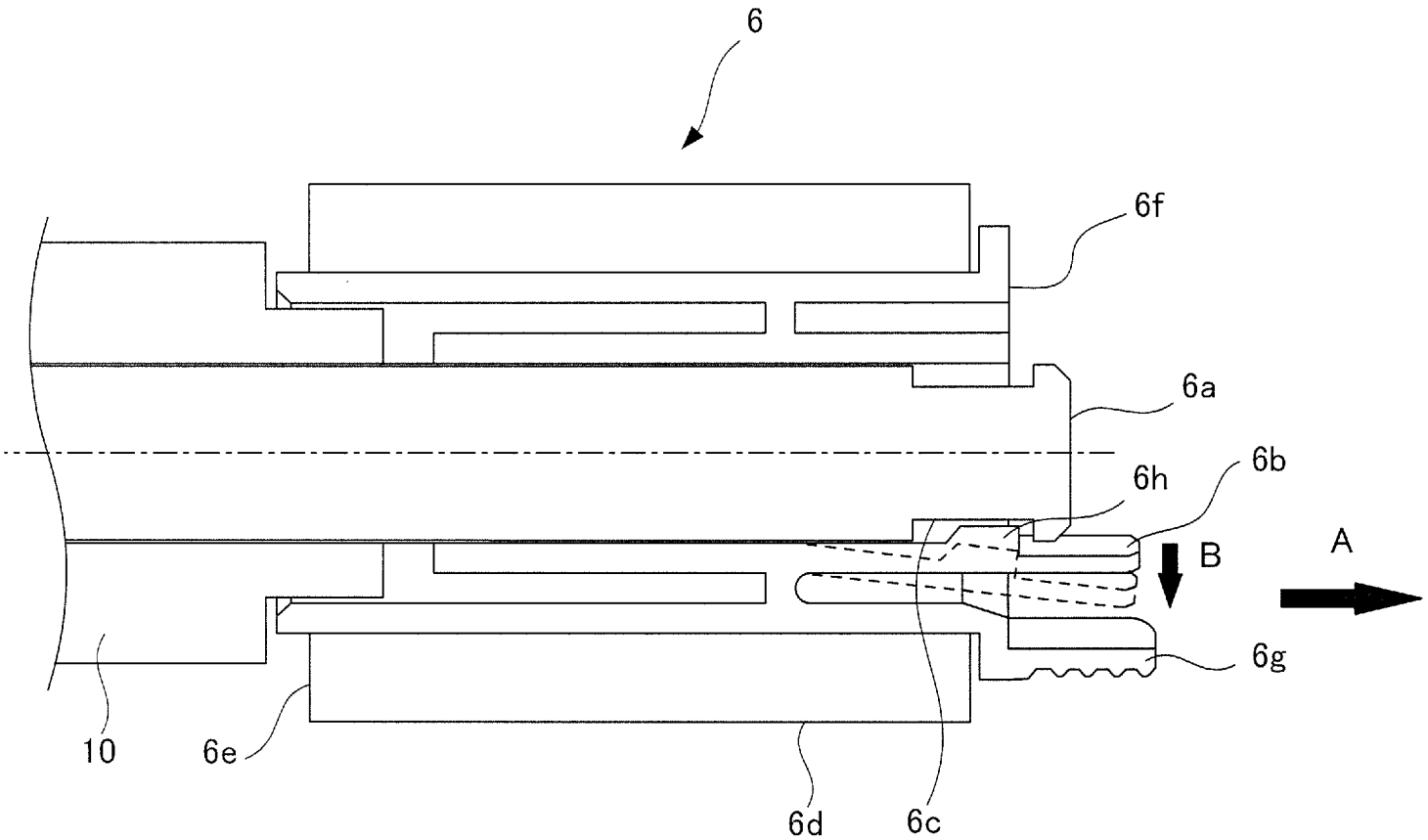
FIG. 3 is a section view of a retard roller seen from the side.

As illustrated in FIGS. 2 and 3, the retard roller 6 is rotatably supported by a supporting shaft 6*a*. The supporting shaft 6*a* is a separation shaft driven by a motor that is not illustrated. A torque limiter 10 is interposed between the supporting shaft 6*a* and the retard roller 6, and a drive is input to the supporting shaft 6*a* in a direction opposite to a conveyance direction of the sheet P. In a state where no sheet P or a single sheet P has entered the separation nip N, the torque limiter 10 idles, and thus the retard roller 6 rotates along with the feed roller 5 to convey the sheet P in a sheet feeding direction orthogonal to the drawing-out direction.

In a state where two or more sheets P have entered the separation nip N, the retard roller 6 rotates against the sheet conveyance direction to separate the doubly fed sheets P from one another. The sheets P can be separated from one another because the frictional force between the sheets P is small.

As illustrated in FIG. 3, an engagement recess 6*c* is defined on the supporting shaft 6*a*. The engagement recess 6*c* is a recessed portion that is defined on the periphery of one end portion of the supporting shaft 6*a*. The retard roller 6 includes an outer periphery portion 6*d*, a locking claw 6*b*, and a grip portion 6*g*. The outer periphery portion 6*d* is formed of, for example, rubber, and abuts the sheet P. The locking claw 6*b* is formed of, for example, resin. The locking claw 6*b* includes a claw portion 6*h* that is capable of engaging with and disengaging from the engagement recess 6*c* by being elastically deformed by a user. That is, the user can remove the retard roller 6 from the supporting shaft 6*a* by, for example, elastically deforming the locking claw 6*b* with other fingers than one finger while pressing the grip portion 6*g* with the one finger.

The configurations for removing the pickup roller 4 and the feed roller 5 are the same as that for the retard roller 6 and the descriptions thereof are thus omitted herein.

Separating Mechanism

As illustrated in FIG. 4, the separating mechanism 30 includes a rotation shaft 31 and a roller holder 14. The rotation shaft 31 is rotatably supported by the feeding unit 2, and the roller holder 14 supports the supporting shaft 6*a* in such a manner that the supporting shaft 6*a* is capable of swinging about the rotation shaft 31. The roller holder 14 is urged by a nip pressurizing spring 15, which is an urging portion, in such a direction as to bring the retard roller 6 into contact with the feed roller 5. In addition, the separating mechanism 30 includes a pressure cancelling lever 12 which is movable and a pressure cancelling spring 13 disposed between the pressure cancelling lever 12 and a frame 2A of the feeding unit 2 illustrated in FIG. 5 through a pressure cancelling spring 13. The urging force of the pressure cancelling spring 13 is set so as to be greater than that of the nip pressurizing spring 15.

In addition, a projection portion 3*a* is formed on a side surface of the cassette 3. The projection portion 3*a* abuts the pressure cancelling lever 12 in a state where the cassette 3 is attached to the printer body 201A. That is, in the case where the cassette 3 is attached to the printer body 201A, the projection portion 3*a* presses the pressure cancelling lever 12 against the urging force of the pressure cancelling spring 13. In this state, the pressure cancelling lever 12 does not interfere with the roller holder 14, and thus the roller holder 14 is caused to pivot upward by the nip pressurizing spring 15. As a result of this, the retard roller 6 abuts the feed roller 5 with a predetermined nip pressure.

In the case where the cassette 3 is detached from the printer body 201A, the projection portion 3*a* formed on the cassette 3 and the pressure cancelling lever 12 are disengaged from each other, and the pressure cancelling lever 12 is moved by the pressure cancelling spring 13. After that, the roller holder 14 abuts the pressure cancelling lever 12 and is caused to move downward against the urging force of the nip pressurizing spring 15 by the urging force of the pressure cancelling spring 13. This causes the retard roller 6 to move away from the feed roller 5, and, as a result, the user can easily replace the feed roller 5 and the retard roller 6 without a resistance force by the nip pressure between the feed roller 5 and the retard roller 6.

Conveyance Guide

The configuration of the conveyance guide 8 will be described in detail next with reference to FIGS. 2, 5, and 7. The conveyance guide 8 is provided integrally with the frame 2A of the feeding unit 2 and is formed in an approximately arc shape so as to cover the retard roller 6. The conveyance guide 8 includes a guide surface 8*a* that is formed as an upper surface thereof and guides the sheet P to the separation nip N. The conveyance guide 8 also includes a cutout hole 8*b* defined in a side surface 8*d* that opposes the cassette 3 in an attached state at a position below the guide surface 8*a*. The cutout hole 8*b* is an exposing portion and the side surface 8*d* is an opposing surface. That is, the cutout hole 8*b* is an opening defined in a position that is not in the guide surface 8*a*, and the cutout hole 8*b* overlaps the retard roller in the drawing-out direction, i.e., an arrow A direction. In addition, the side surface 8*d* of the conveyance guide 8 also functions as a reinforcing portion of the conveyance guide 8 and covers the retard roller 6 at a position below the guide surface 8*a*. The cutout hole 8*b* exposes a second end portion 6*e* opposite to a first end portion 6*f* that is on the side where the locking claw 6*b* of the retard roller 6 is disposed. The cutout hole 8*b* is defined, for example, in a rectangular shape each side of which is 10 mm to 30 mm long. The first end portion 6*f* is a downstream end portion and the second end portion 6*e* is an upstream end portion in the drawing-out direction of the cassette 3.

Detachment of Rollers

Figure 6:
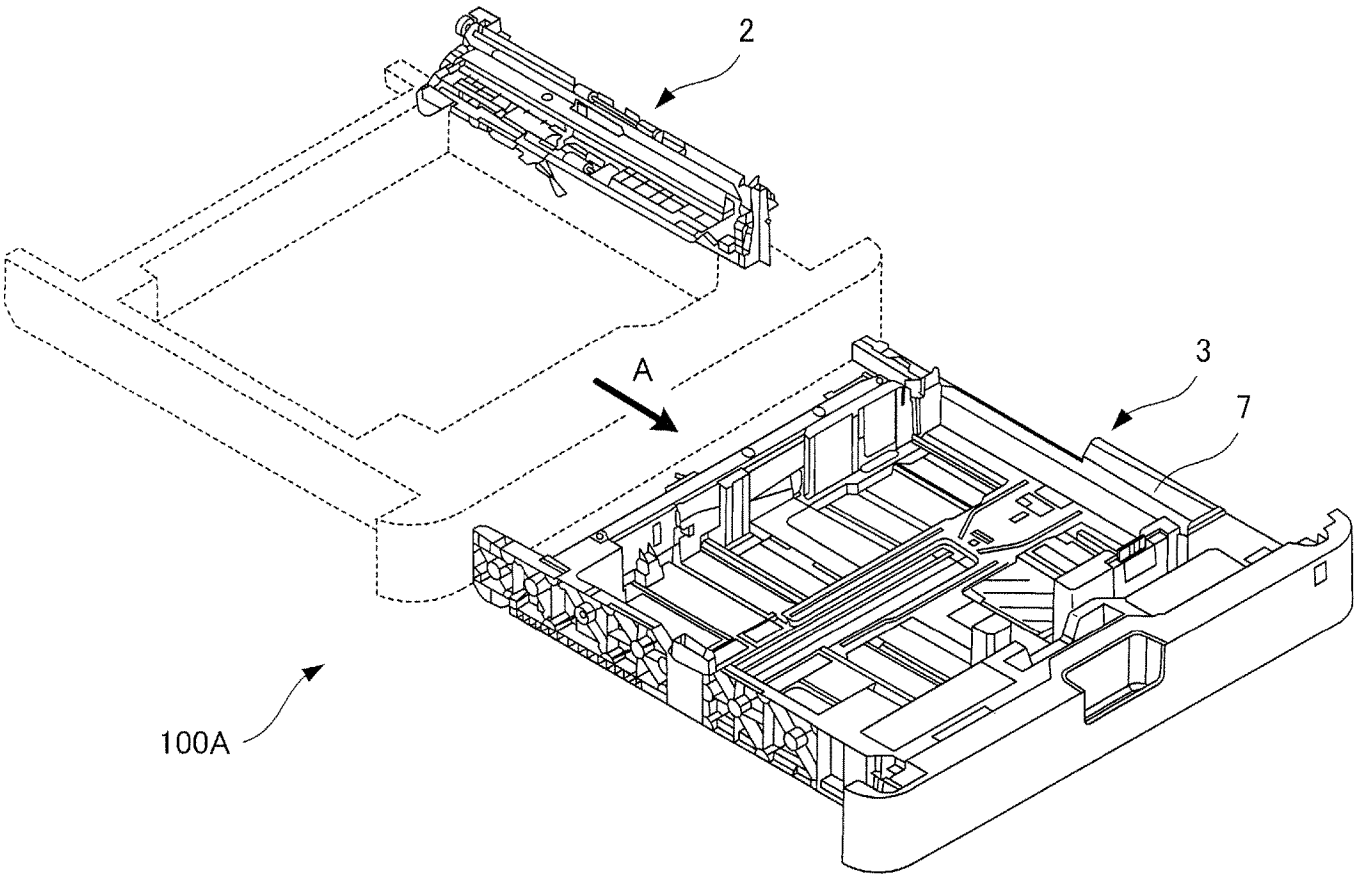
FIG. 6 is a perspective view illustrating a state in which a cassette is detached.

Process of detaching the pickup roller 4, the feed roller 5, and the retard roller 6 in performing replacement and maintenance of these rollers will be described next. First, the user detaches the cassette 3 from the printer body 201A by drawing out the cassette 3 to the front, i.e., in the arrow A direction, as illustrated in FIG. 6. As a result of this, the cassette guide 7 covering the front side of the retard roller 6 is removed along with the cassette 3, and it becomes possible to utilize the space from which the cassette 3 has been removed as an operation space for performing replacement of the rollers. While detaching the cassette 3, the projection portion 3*a* and the pressure cancelling lever 12 are disengaged from each other, and the retard roller 6 is caused to move away from the feed roller 5 by the separating mechanism 30.

Figure 7:
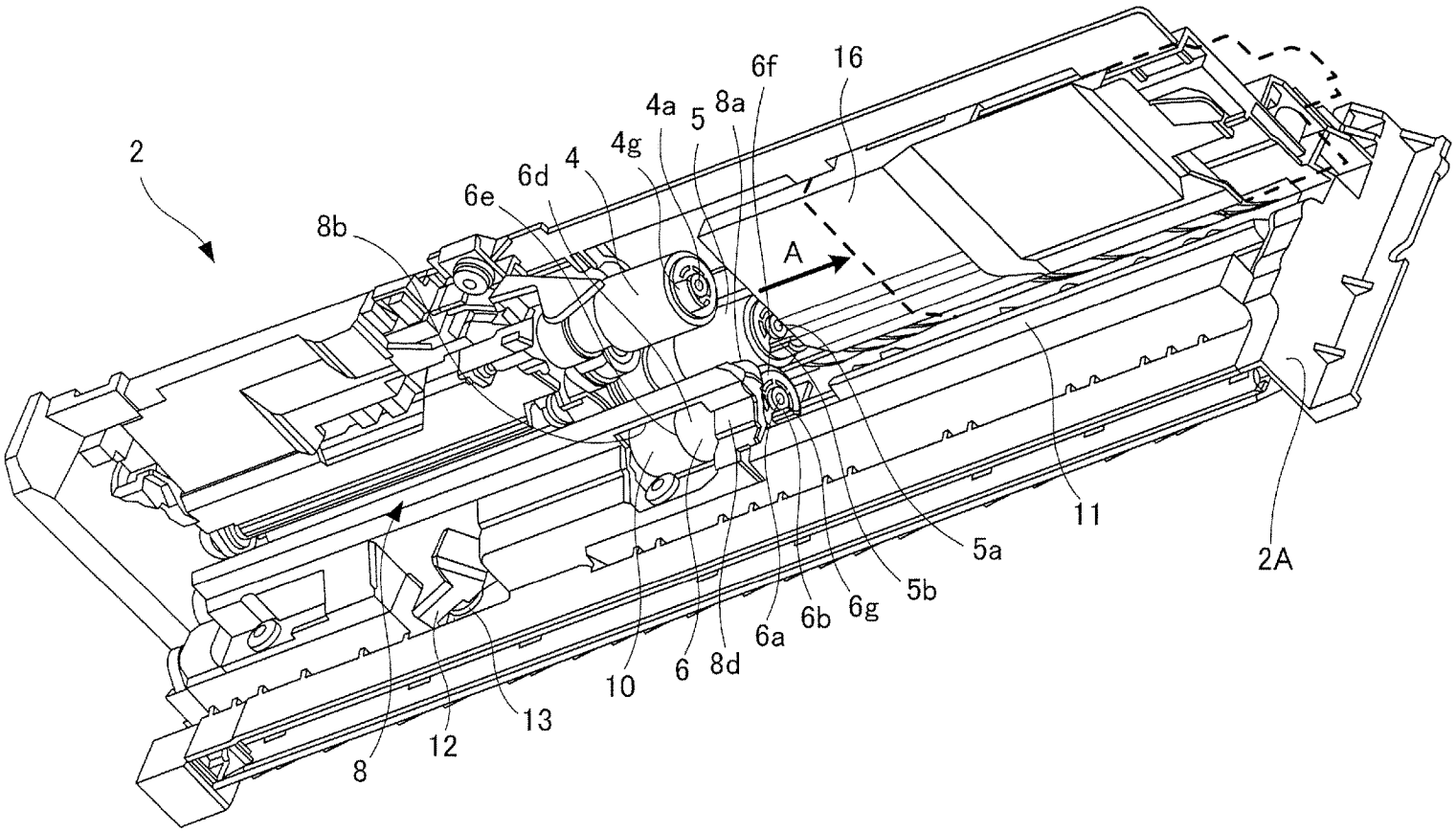
FIG. 7 is a perspective view of a conveyance upper guide of the feeding unit.
Figure 8:
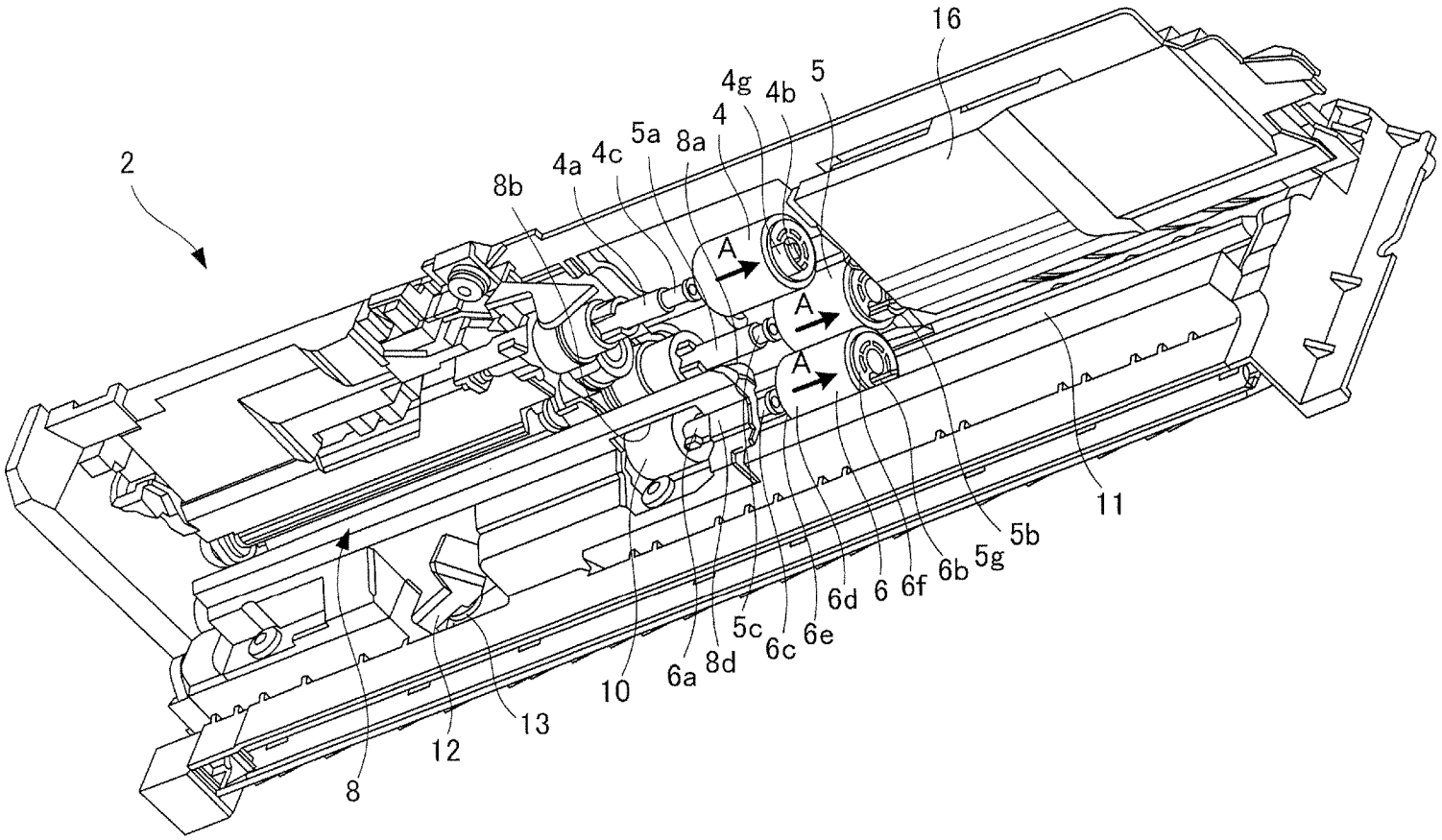
FIG. 8 is a perspective view illustrating a state in which rollers are detached.

Subsequently, the user slides the conveyance upper guide 16 in the arrow A direction, which is the drawing-out direction of the cassette 3, as illustrated in FIG. 7. This action provides a space in front of the pickup roller 4 and the feed roller 5 for detaching the pickup roller 4 and the feed roller 5. Then, the user cancels the engagement between the locking claws 4*b*, 5*b*, and 6*b* and the engagement recesses 4*c*, 5*c*, and 6*c* of the supporting shafts 4*a*, 5*a*, and 6*a* included by the pickup roller 4, the feed roller 5, and the retard roller 6 to detach these rollers in the arrow A direction.

In this case, since there is a sufficient operation space near the pickup roller 4 and the feed roller 5, these rollers can be detached with ease. In contrast, the outer periphery portion 6*d* of the retard roller 6 is covered by the conveyance guide 8 and the downstream conveyance guide 11. Thus, in the case where, for example, the retard roller 6 is reduced in diameter, the operation of replacement may become difficult because the locking claw 6*b* and the grip portion 6*g* are also reduced in size and the locking claw 6*b* becomes difficult to hold.

Therefore, in the present exemplary embodiment, the cutout hole 8*b* is provided such that the second end portion 6*e* of the retard roller 6 is exposed and the user can access the second end portion 6*e* through the cutout hole 8*b*. For example, in detaching the retard roller 6, the user warps the locking claw 6*b* with the thumb of the left hand and separates the claw portion 6*h* from the engagement recess 6*c*. In this state, the user sticks the index finger into the cutout hole 8*b* and pushes out the second end portion 6*e* of the retard roller 6 in the arrow A direction. In the case where the retard roller 6 is pushed out in the arrow A direction by pushing the second end portion 6*e*, the outer periphery of the retard roller 6 on the first end portion 6*f* side is exposed, and thus the user can easily detach the retard roller 6 by holding the exposed outer periphery.

This allows an easy replacement of the retard roller 6 even in the case where a sufficient space for holding the locking claw 6*b* is not secured on the first end portion 6*f* side. In addition, since the cutout hole 8*b* is provided in a position that is not in the guide surface 8*a*, the cutout hole 8*b* does not affect the conveyance of the sheet and does not degrade the performance of sheet conveyance. The configuration in which the retard roller 6 can be taken out from the drawing-out direction of the cassette 3 suppresses discontinuation of image forming operation. With a configuration in which the door 20 is opened to detach the retard roller 6 in the direction of the door 20, the image forming operation needs to be stopped in replacement of the retard roller 6 because the door 20 is opened and the conveyance path CP is exposed. In the present exemplary embodiment having the configuration illustrated in FIG. 1, the image forming operation does not need to be stopped because the sheet P can be fed from the cassette feeder 100B even in the case where the cassette feeder 100A is drawn out in order to replace the retard roller 6 of the cassette feeder 100A.

Although the cutout hole 8*b* of the present exemplary embodiment is defined in a rectangular shape each side of which is 10 mm to 30 mm long such that the index finger passes therethrough, the shape or the size of the cutout hole 8*b* is not limited to this example. That is, the shape and the size of the cutout hole 8*b* may be arbitrarily set as long as the cutout hole 8*b* exposes at least part of the retard roller 6, is wide enough to allow the index finger to pass therethrough, and secures a sufficient space to push out the retard roller 6.

Moreover, although a driving force against the sheet conveyance direction is input to the retard roller 6 of the present exemplary embodiment, this driving force may not be input. In addition, a separation pad may be provided in place of the retard roller 6. Furthermore, although the cutout hole 8*b* is defined in the side surface 8*d* of the conveyance guide 8, the cutout hole 8*b* may be defined at any position that is not in the guide surface 8*a*.

Second Exemplary Embodiment

The second exemplary embodiment of the present invention will be described next. The second exemplary embodiment is configured by modifying the cutout hole 8*b* of the first exemplary embodiment. The same components as the first exemplary embodiment will be illustrated with the same numerals as the first exemplary embodiment or the illustration thereof will be omitted.

Conveyance Guide

Figure 9:
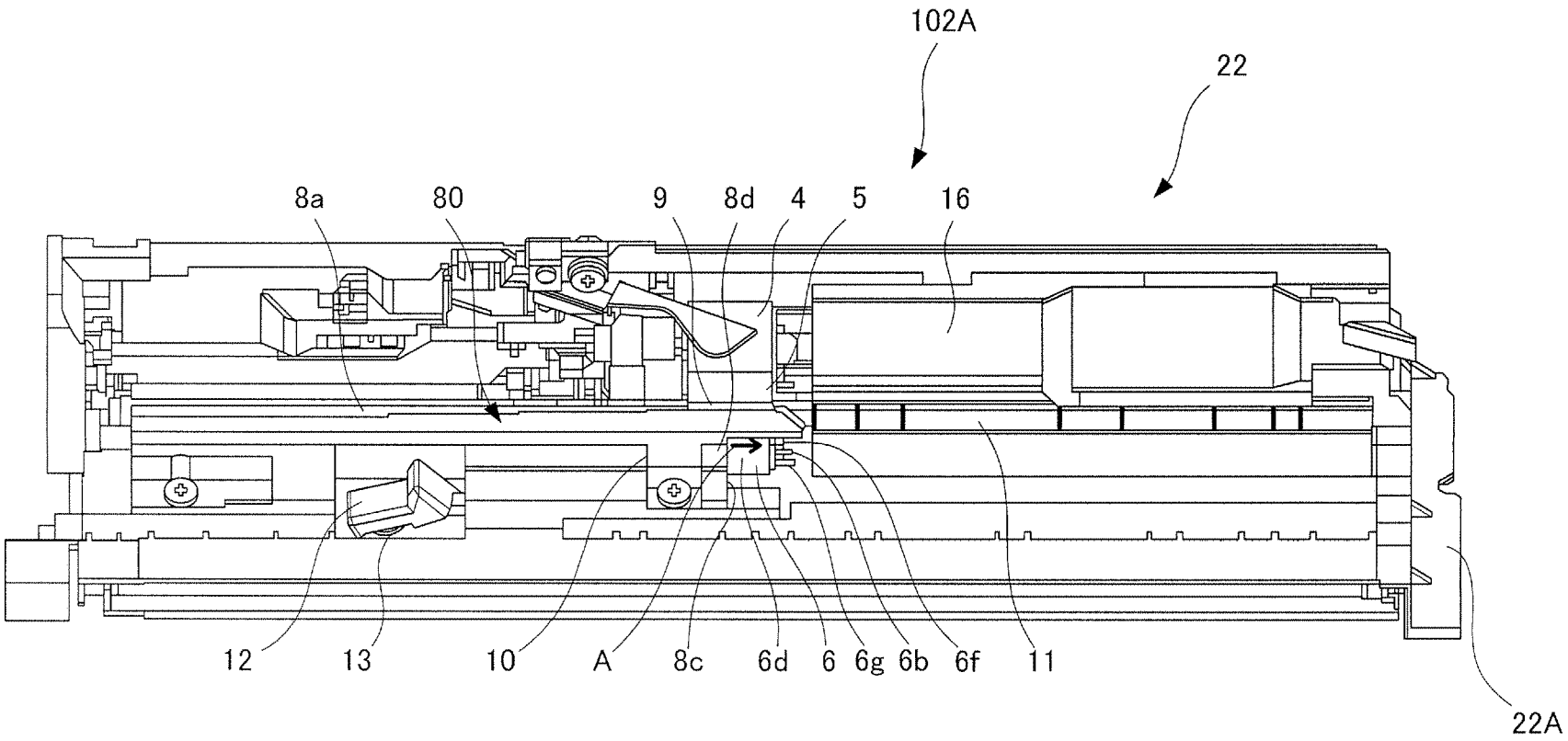
FIG. 9 is a bottom view of a feeding unit according to a second exemplary embodiment.

A cassette feeder 102A, which is a sheet feeding apparatus, of the present exemplary embodiment includes the cassette 3 and a feeding unit 22. The feeding unit 22 includes a conveyance guide 80. The conveyance guide 80 is a guide member that is integrally provided with a frame 22A of the feeding unit 22 and guides the sheet P to the separation nip N. As illustrated in FIG. 9, the conveyance guide 80 also includes a cutout portion 8*c* defined in the side surface 8*d* of the conveyance guide 80 positioned below the guide surface 8*a*. The cutout portion 8*c* is an exposing portion and is defined so as to overlap the retard roller 6 in the drawing-out direction, i.e., the arrow A direction.

More specifically, the cutout portion 8*c* is a cutout each side of which is about 20 mm to 30 mm long. The cutout portion 8*c* exposes the first end portion 6*f*, which is the downstream end portion, of the retard roller 6. With this configuration, the space for holding the retard roller 6 is secured and the user can hold the retard roller 6 by, for example, nipping the outer periphery portion 6*d* of the retard roller 6 exposed by the cutout portion 8*c* and the locking claw 6*b* with the thumb and the index finger of the right hand.

In addition, the retard roller can be replaced easily with the configuration above, even in the case where, for example, there is not much difference between the outer diameters of the retard roller 6 and the torque limiter 10 and thus it is difficult to push out the retard roller 6 by pushing the second end portion 6*e* as in the first exemplary embodiment. Moreover, since the cutout portion 8*c* is provided in a position that is not in the guide surface 8*a*, the cutout portion 8*c* does not affect the conveyance of the sheet and does not degrade the performance of sheet conveyance.

Although the cutout portion 8*c* of the present exemplary embodiment is defined in a shape one side of which is 20 mm to 30 mm long such that the thumb passes therethrough, the shape or the size of the cutout portion 8*c* is not limited to this example. That is, the shape and the size of the cutout portion 8*c* may be arbitrarily set as long as the cutout portion 8*c* is wide enough to allow the thumb to pass therethrough, and secures a sufficient space to push out the retard roller 6.

Alternatively, the cutout hole 8*b* of the first exemplary embodiment and the cutout portion 8*c* of the second exemplary embodiment may be both defined in the conveyance guide 8 or 80. This also facilitates replacement of the retard roller 6.

Moreover, although the retard roller 6 is detached in the drawing-out direction of the cassette 3 in the first and second exemplary embodiments, the detachment direction is not limited to this. For example, the detachment direction of the retard roller 6 and the drawing-out direction of the cassette 3 may cross.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-172809, filed Sep. 2, 2015, which is hereby incorporated by reference herein in its entirety.

What is claimed is:

1. A sheet feeding apparatus comprising:

an apparatus body;

a supporting portion configured to support a sheet and to be drawn out in a drawing-out direction from the apparatus body and attached to the apparatus body; and a feeding unit provided in the apparatus body, the feeding unit comprising:

a feeding portion configured to feed the sheet supported by the supporting portion;

a conveyance portion configured to convey the sheet fed by the feeding portion;

a separation portion configured to form a separation nip, in which sheets are separated one by one, with the conveyance portion, the separation portion being detachable from the feeding unit in the drawing-out direction; and a guide member comprising a guide surface and a lower portion, the guide surface being configured to guide the sheet fed by the feeding portion to the separation nip, the lower portion being provided below the guide surface and defining an exposing area exposing at least a part of the separation portion to a space appearing in a case where the supporting portion has been drawn out from the apparatus body, wherein the guide surface and the exposing area overlap the separation portion in the drawing-out direction.

2. The sheet feeding apparatus according to claim 1, wherein the exposing area is configured to expose an upstream end portion of the separation portion in the drawing-out direction.

3. The sheet feeding apparatus according to claim 2, wherein the exposing area is an opening provided in the lower portion.

4. The sheet feeding apparatus according to claim 3, wherein a length of at least one side of the opening is 10 mm to 30 mm.

5. The sheet feeding apparatus according to claim 1, wherein the exposing area is configured to expose a downstream end portion of the separation portion in the drawing-out direction.

6. The sheet feeding apparatus according to claim 5, wherein the exposing area is a cutout provided in the lower portion.

7. The sheet feeding apparatus according to claim 6, wherein a length of at least one side of the cutout is 20 mm to 30 mm.

8. The sheet feeding apparatus according to claim 1, wherein the feeding unit comprises an urging unit and a separating mechanism, the urging unit being configured to urge the separation portion toward the conveyance portion, the separating mechanism being configured to move the separation portion away from the conveyance portion against an urging force of the urging unit in a case where the supporting portion is drawn out in the drawing-out direction.

9. The sheet feeding apparatus according to claim 1, wherein the supporting portion comprises a downstream guide portion that is provided downstream of the separation portion in the drawing-out direction and configured to guide the sheet to the separation nip, and the guide surface is provided upstream of the downstream guide portion in the drawing-out direction and configured to guide the sheet to the separation nip.

10. The sheet feeding apparatus according to claim 9, wherein the feeding unit comprises a movable member that is configured to guide the sheet to the separation nip while opposing the downstream guide portion and is movable in the drawing-out direction.

11. The sheet feeding apparatus according to claim 1, wherein the feeding unit comprises a separation shaft, on which a recessed portion is formed, rotatably supported by the apparatus body, the separation portion is a roller detachable from the separation shaft, and the roller comprises a locking claw that is capable of engaging with and disengaging from the recessed portion.

12. The sheet feeding apparatus according to claim 11, wherein the locking claw is formed on a downstream end portion of the roller in the drawing-out portion.

13. The sheet feeding apparatus according to claim 1, wherein the lower portion is an opposing surface that opposes the supporting portion attached to the apparatus body.

14. An image forming apparatus comprising:

the sheet feeding apparatus according to claim 1; and an image forming unit configured to form an image on the sheet fed by the sheet feeding apparatus.

15. A sheet conveyance apparatus comprising:

an apparatus body a cassette configured to support a sheet and to be drawn out in a drawing-out direction from the apparatus body; and a conveyance unit provided in the apparatus body, the conveyance unit comprising:

a conveyance rotary member configured to convey a sheet;

a rotation shaft rotatably supported by the apparatus body;

a retard roller that is capable of being in contact with the conveyance rotary member and is detachable from the rotation shaft in the drawing-out direction;

a torque limiter provided between the rotation shaft and the retard roller; and a guide member comprising a guide surface and a lower portion, the guide surface being configured to guide a sheet to a contact portion at which the conveyance rotary member and the retard roller come into contact, the lower portion being provided below the guide surface and defining an exposing area exposing at least a part of the retard roller to a space appearing in a case where the cassette has been drawn out from the apparatus body, wherein the guide surface and the exposing area overlap the retard roller in the drawing-out direction.

16. The sheet conveyance apparatus according to claim 15, wherein the exposing area is an opening provided in the lower portion.

17. The sheet conveyance apparatus according to claim 16, wherein a length of at least one side of the opening is 10 mm to 30 mm.

18. The sheet conveyance apparatus according to claim 15, wherein the exposing area is a cutout provided in the lower portion.

19. The sheet conveyance apparatus according to claim 18, wherein a length of at least one side of the cutout is 20 mm to 30 mm.

20. The sheet conveyance apparatus according to claim 15, wherein the lower portion is an opposing surface that opposes the cassette attached to the apparatus body.

21. An image forming apparatus comprising:

the sheet conveyance apparatus according to claim 15; and an image forming unit configured to form an image on the sheet conveyed by the sheet conveyance apparatus.

* * * * *